United States Patent [19]

Highsmith, Jr.

[11] 4,300,342

[45] Nov. 17, 1981

[54] ROVING FRAME STOP APPARATUS

[75] Inventor: James L. Highsmith, Jr., Charlotte, N.C.

[73] Assignee: El-Trol, Inc., Charlotte, N.C.

[21] Appl. No.: 100,451

[22] Filed: Dec. 5, 1979

[51] Int. Cl.[3] ..... D01H 13/16

[52] U.S. Cl. ..... 57/81

[58] Field of Search ..... 57/78, 80, 81, 324, 57/264, 265

[56] References Cited

U.S. PATENT DOCUMENTS

| | | | |
|---|---|---|---|
| 3,043,991 | 7/1962 | Schneider et al. | 57/81 X |
| 3,309,859 | 3/1967 | Vehorn | 57/81 |
| 3,576,560 | 4/1971 | Vermeulen et al. | 57/81 X |
| 4,095,401 | 6/1978 | Mori et al. | 57/81 |

*Primary Examiner*—Donald Watkins

*Attorney, Agent, or Firm*—Bell, Seltzer, Park & Gibson

[57] ABSTRACT

An end detector for detecting an interruption in an individual textile strand being processed on a textile machine and the combination of such detector with others mounted on a roving frame.

13 Claims, 8 Drawing Figures

ROVING FRAME STOP APPARATUS

FIELD AND BACKGROUND OF INVENTION

The process of preparing fibrous textile material for yarn manufacture includes a step of preparing a strand material known as roving. Roving is a relatively bulky and softly twisted strand of fibrous material in which the fibers have been generally aligned by a drafting process but which has not been attenuated to the extent typical in a yarn. The preparation of roving is accomplished by a textile machine known as a roving frame which has a plurality of drafting systems each of which receives one or more slivers and delivers a roving strand to a flyer, by which the roving is packaged by winding about a bobbin.

It has long been recognized that damage to a roving frame can result from the breakage or interruption of a roving strand intermediate a drafting system and a flyer. One form of such damage results from a "lap-up" of textile fiber about the delivery or front rolls of a drafting system. Further, such breakage of a roving strand can result in creation of textile fiber waste, which is undesirable for reasons of attaining manufacturing efficiency and quality.

It has been proposed heretofore that a roving frame may be provided with apparatus for sensing the interruption of roving delivery and stopping operation of the roving frame. One such apparatus is illustrated, for example, in Vehorn U.S. Pat. No. 3,309,859 issued Mar. 21, 1967. To any extent necessary to a clear understanding of the present invention, the disclosure of the Vehorn patent is hereby incorporated by reference into the present description. In the Vehorn control system for a textile roving frame, a plurality of sets of light sources and photoelectric detectors are provided, with each set viewing an area which extends longitudinally of the roving frame. The intended operation of the Vehorn control system, as disclosed in the aforementioned United States patent, is to stop operation of the roving frame upon interruption of any roving strand or runout of any sliver being supplied.

While the Vehorn control system has achieved acceptance, it is not capable of detecting a lap-up and, in its original form, encountered difficulty due to misalignment of roving frames. It has been discovered that such textile machines frequently are not properly aligned and that the flyers of such machines, if out of balance, will vibrate excessively. In any such event, a photoelectric receiver attempting to view a line or area extending lengthwise of a roving frame may respond to flyer vibration or misalignment, rather than to roving strand breaks. The roving operation is then subjected to false stops, in that the frame will be cut off when there is, in fact, no failure in proper operation of the frame. With the exception of lap-up detection, these difficulties have been avoided by recent Vehorn systems.

An alternative approach to a roving frame stop apparatus or stop motion device has been disclosed in Schneider et al U.S. Pat. No. 3,043,991 issued July 10, 1962. There, a plurality of individual detector units are arranged along the length of a roving frame, each monitoring a respective individual roving strand. To any extent necessary or appropriate to the understanding of the present invention, the disclosure to be found in the Schneider et al patent is hereby incorporated by reference into the present description. On first impression, an individual end detection device or unit as disclosed by Schneider et al U.S. Pat. No. 3,043,991 appears to overcome a number of the difficulties of the Vehorn type control system. Indeed, an individual end detector system does have certain capabilities, as pointed out more fully hereinafter, distinctive from those which can be accomplished by a control system of the Vehorn type. However, the Schneider et al stop motion device and control circuit therefor suffers from certain shortcomings, difficulties or deficiencies which have led to a failure of commercial acceptance of the Schneider et al arrangement. More specifically, the misalignment and vibration mentioned above in describing certain of the difficulties of a Vehorn control system cause "dancing" or vibrating motion of roving strands passing through a Schneider et al individual end detector. Such motion of a roving strand presents an initial alignment difficulty for a Schneider et al individual end detector, in that the roving strand does not predictably remain in a specific location, and may cause false stops. Further, alignment of the individual end detector devices of Schneider et al is difficult to accomplish reliably, particularly in view of the probable need of moving the device in order to accommodate doffing or removal of filled bobbins and in order to accommodate piecing up or reinstitution of roving packaging.

BRIEF DESCRIPTION OF INVENTION

With the aforementioned alternative approaches to roving stop arrangements and the problems thereof in mind, it is an object of the present invention to provide, in a roving frame, a control system or stop apparatus capable of responding to roving strand interruptions of any type and thereby overcoming the deficiencies of the prior proposed systems. In realizing this object of the present invention, provision is made for coordinating through a single electrical circuit the operation of a control system scanning a plurality of roving strand positions and a control system having a plurality of individual end detectors each monitoring a respective individual strand location. By such cooperation, more effective protection of a roving frame is facilitated.

Yet a further object of the present invention is to provide an individual end detector, for use with a roving frame, which includes indicator means for providing a readily visible indication of the functioning of a respective individual end detector and a controllable latching or maintaining of such indication for thereby facilitating adjustment and alignment of the individual end detector to the end that a more accurate indication of the occurrence of an interruption in a roving strand is accomplished.

BRIEF DESCRIPTION OF DRAWINGS

Some of the objects of the invention having been stated, other objects will appear as the description proceeds, when taken in connection with the accompanying drawings, in which.

DETAILED DESCRIPTION OF INVENTION

While the present invention will be described more fully hereinafter with reference to the accompanying drawings, it is to be understood at the outset of the detailed description which follows that it is contemplated that persons skilled in the appropriate arts may modify specific characteristics of the invention described hereinafter while still attaining the beneficial result of this invention. For that reason, the description which follows is to be understood as a broad teaching directed to persons skilled in the appropriate arts, and is not to be restricted to the specific details given in describing the best mode now contemplated for this invention.

Figure 1:
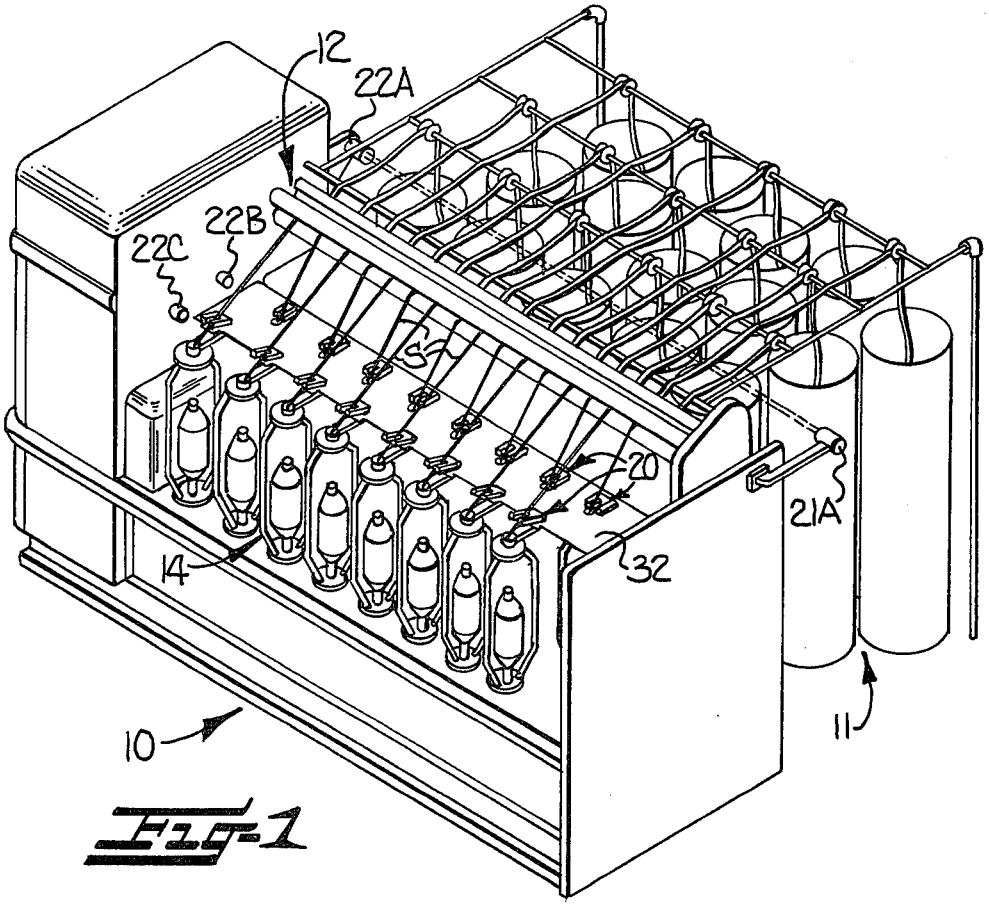
FIG. 1 is a perspective view of a roving frame incorporating the stop apparatus of the present invention.

A roving frame, generally indicated at 10, of one known conventional type is illustrated in FIG. 1. The roving frame there illustrated is available, in the United States, from Platt Saco Lowell under their trademark "Rovematic". While such a roving frame 10 provides a particularly advantageous environment for the combination of the present invention, it is contemplated that the invention to be described hereinafter is applicable to other known roving frames as well and is not limited in its applicability to roving frames of the type particularly shown. In the operation of the roving frame, sliver is delivered from containers or cans generally indicated at 11 to drafting systems generally indicated at 12 for drafting of the sliver into roving strands S. The roving strands advance from the drafting systems 12 to flyers generally indicated at 14, by which the roving strands S are wrapped or wound about bobbins to form roving packages in a manner well known to persons skilled in the applicable arts of textile manufacturing.

In accordance with the present invention, the roving frame 10 is provided with a plurality of individual end detectors generally indicated at 20, each cooperating with a corresponding roving strand being processed on the roving frame for detecting the presence or absence of the roving strand as it passes from a corresponding drafting unit to a corresponding flyer. The individual end detectors 20 will be described more fully hereinafter. Additionally, the combination of the present invention includes a photoelectric scanning means, preferably in the form of a plurality of light sources (one of which is visible in FIG. 1 and is generally indicated at 21A) located adjacent one end of the roving frame 10 and a corresponding plurality of photoelectric receivers 22A, 22B, 22C located adjacent the other end of the roving frame 10. Each pair of a light source 21A and a receiver 22A are aligned and define a scanning axis extending longitudinally of the roving frame and oriented for intersecting paths of travel of textile strands under certain conditions. The scanning axis of the pair of a light source 21A and a receiver 22A visible in FIG. 1 is indicated with dashed lines. The arrangement and operation of the photoelectric scanning means will be described more fully hereinafter.

Figure 2:
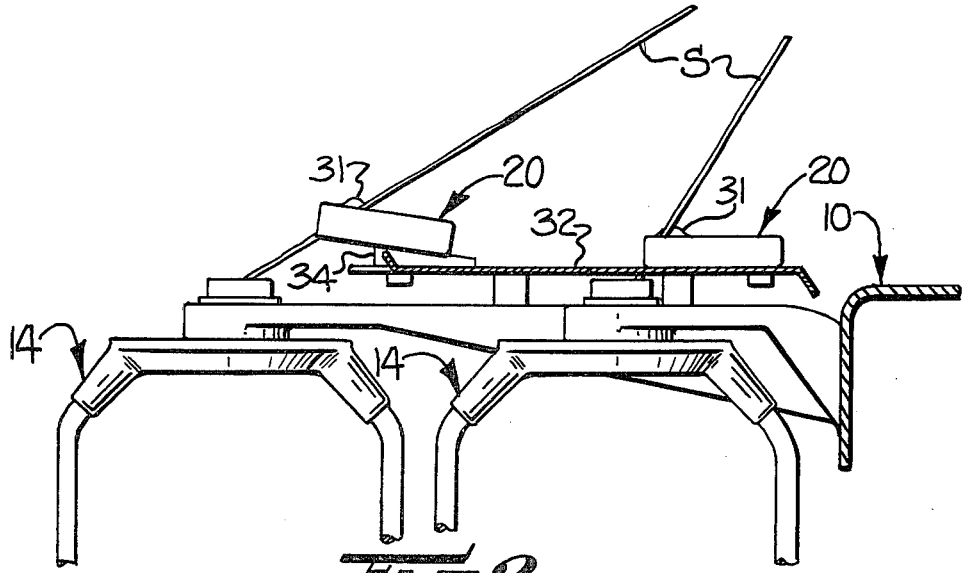
FIG. 2 is an enlarged elevation view, partially in section, of a portion of the roving frame of FIG. 1.
Figure 3:
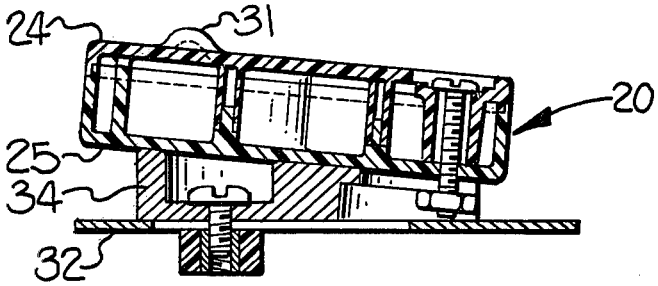
FIG. 3 is a further enlarged sectional elevation view of a portion of the apparatus of the present invention as incorporated in the roving frame of FIGS. 1 and 2.
Figure 4:
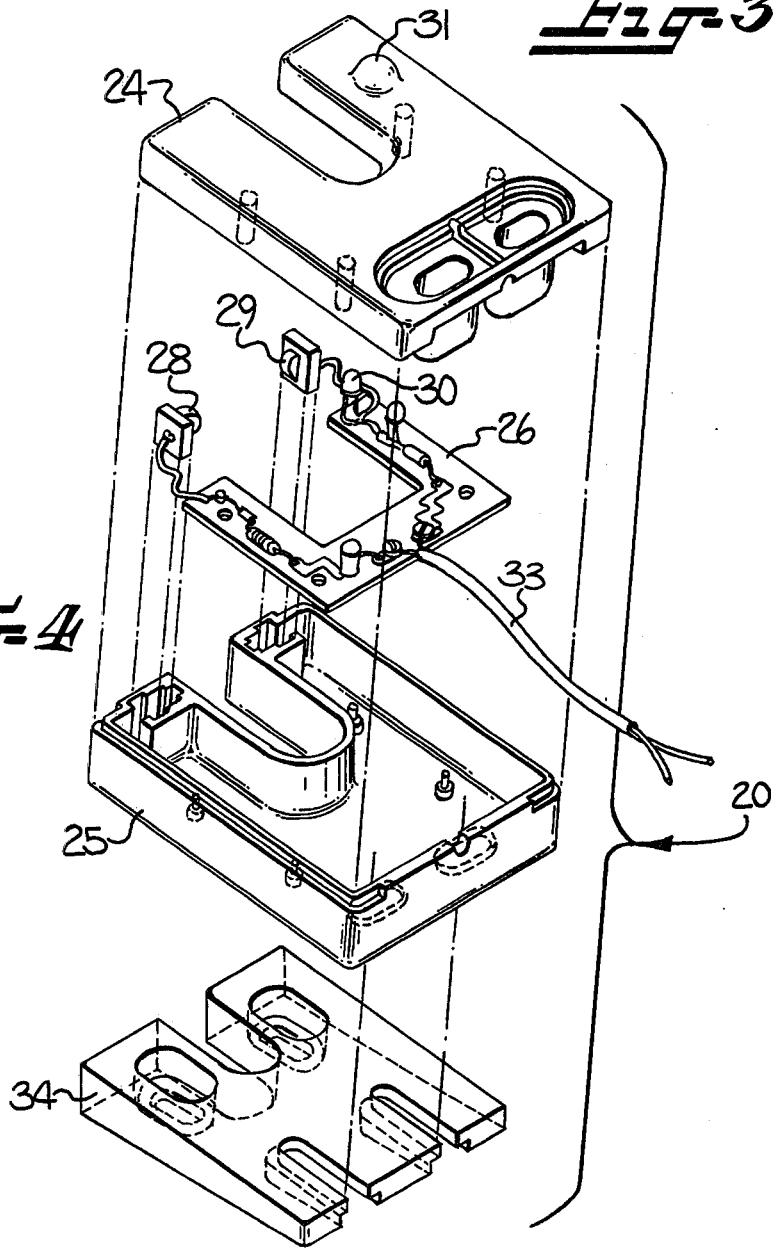
FIG. 4 is an exploded perspective view of the individual end detector illustrated in FIG. 3.

Referring now more particularly to FIGS. 3 and 4, each of the individual end detectors 20 (FIG. 2) preferably includes a housing formed of two mating molded plastic components 24, 25. For purposes to be made more clear hereinafter, the molded housing components 24, 25 preferably are formed of a transparent or translucent plastic material having a particular coloration, such as dark red. The housing defines a pair of legs which, as the individual end detector 20 is mounted for use, extend forwardly for receiving a roving strand S therebetween.

Within the housing 24, 25 is mounted a printed circuit board 26 on which are positioned components of an electrical circuit. Connected to the electrical circuit are a light source 28, in the form of a light emitting diode, and a receiver in the form of a phototransistor or the like 29. Preferably, the spectral response of the phototransistor 29 is selected to peak in a range of light visible as red light and the light emitted from the source 28 is similarly selected. Thus, the housing components 24, 25 appear essentially transparent to radiant energy or light in the spectral region at which the light emitting diode 28 and phototransistor 29 operate. The circuit additionally includes an indicator 30, preferably in the form of a light emitting diode, which is mounted to be received within an upward protrusion 31 on one housing component 24. The indicator 30 serves particular functions as will be described more fully hereinafter. By means of a suitable conductive cable 33, electrical power is brought to each individual end detector 20 and signals are passed therefrom as described more fully hereinafter.

In order to facilitate the installation and alignment of individual end detectors 20 as will be described more fully hereinafter, special provision is made for the grouped mounting of an array of individual detectors on the roving frame 10. More particularly, a tray member 32 (FIGS. 2 and 5) is provided for mounting upon upper bearing arms provided in the roving frame 10. The tray member 32 is provided with openings to overlie an inner or rear row of flyers 14 and with patterns of slots for receiving and mounting individual end detectors 20. Additionally, in order to secure a desired angle as will be pointed out more fully hereinafter, mounting blocks 34 (FIGS. 2 through 5) are provided and are positioned between at least certain individual end detectors 20 and the tray member 32. By means of slotted engagement for a plurality of mounting bolts, the position of an individual end detector 20 relative to the corresponding roving strand S may be accurately adjusted and the end detector 20 securely fastened in place. As is visible particularly in FIG. 2, use of the mounting blocks 34 facilitates maintaining a reasonable angular relation between the path of roving strands S and the housings 24, 25.

Figure 5:
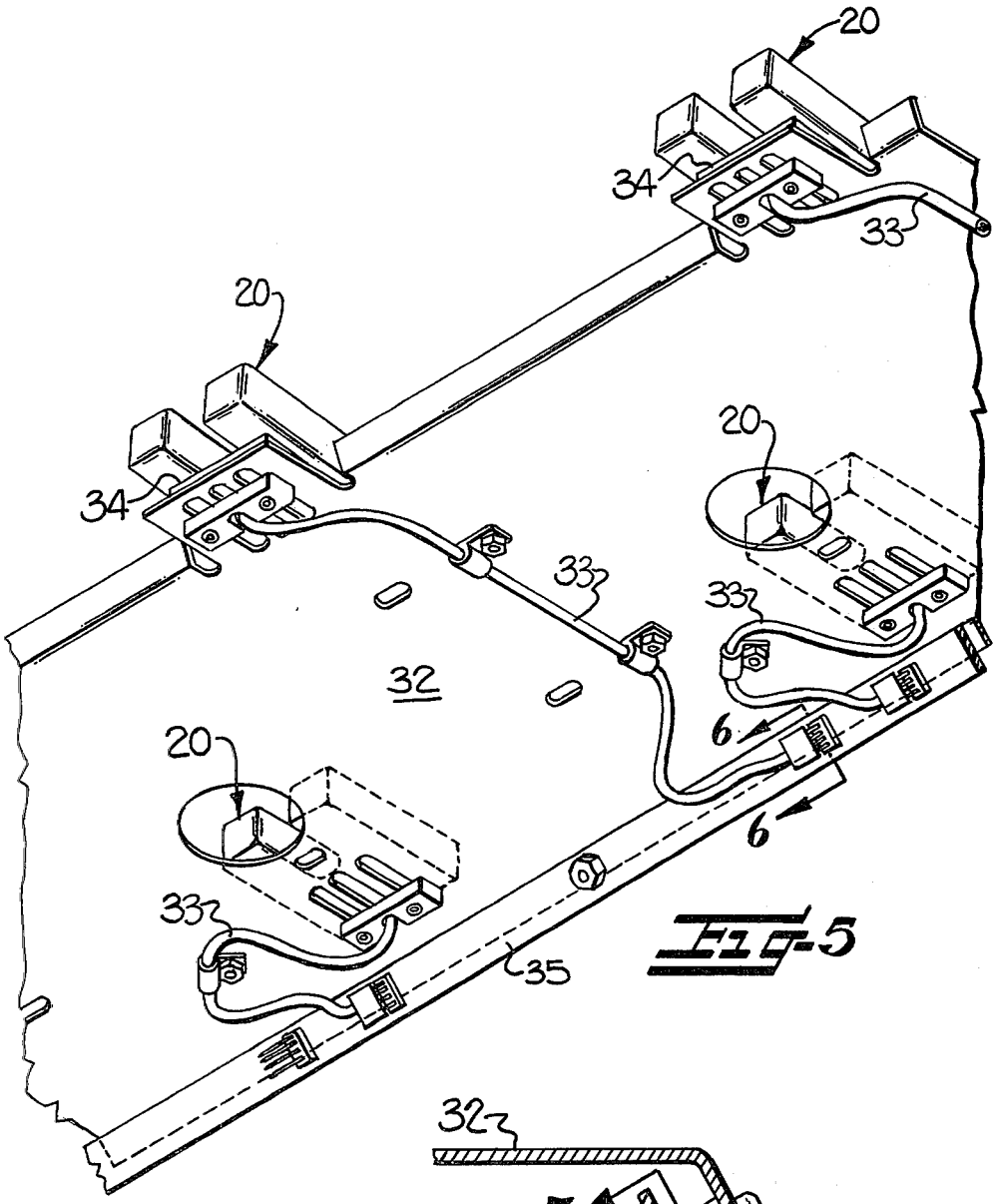
FIG. 5 is a perspective view, from below, of a portion of the apparatus of the present invention as incorporated in the roving frame of FIGS. 1 and 2.
Figure 6:
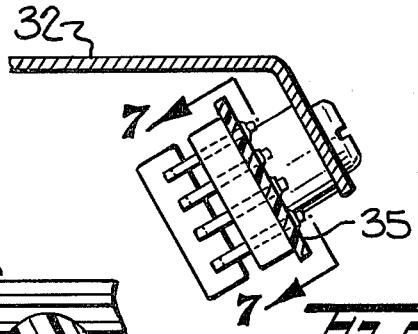
FIG. 6 is an enlarged sectional elevation view of a portion of the apparatus of FIG. 5, taken generally as indicated by the line 6—6 in that figure.
Figure 7:
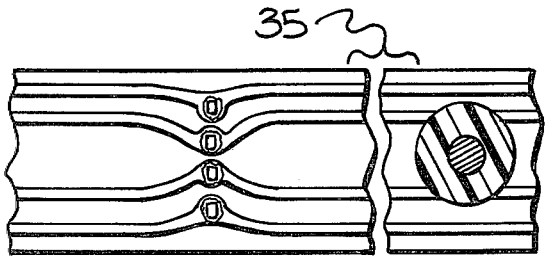
FIG. 7 is a sectional elevation view taken generally along the line 7—7 in FIG. 6.

As will be noted from FIGS. 5 through 7, the use of the tray member 32 permits facilitating electrical interconnections of the end detectors 20 with other circuitry. More particularly, the lowermost surface of the tray member 32 may include a printed circuit bus card 35 mounted near a rearward edge thereof. By means of suitable sockets and pins projecting from the bus board 35, connection for the cables 33 are readily accomplished. Thus, the use of the tray member 32 to provide for readily electrical connection of the individual end detectors 20 with the bus card 35 facilitates ease of installation of the stop apparatus of the present invention.

Figure 8:
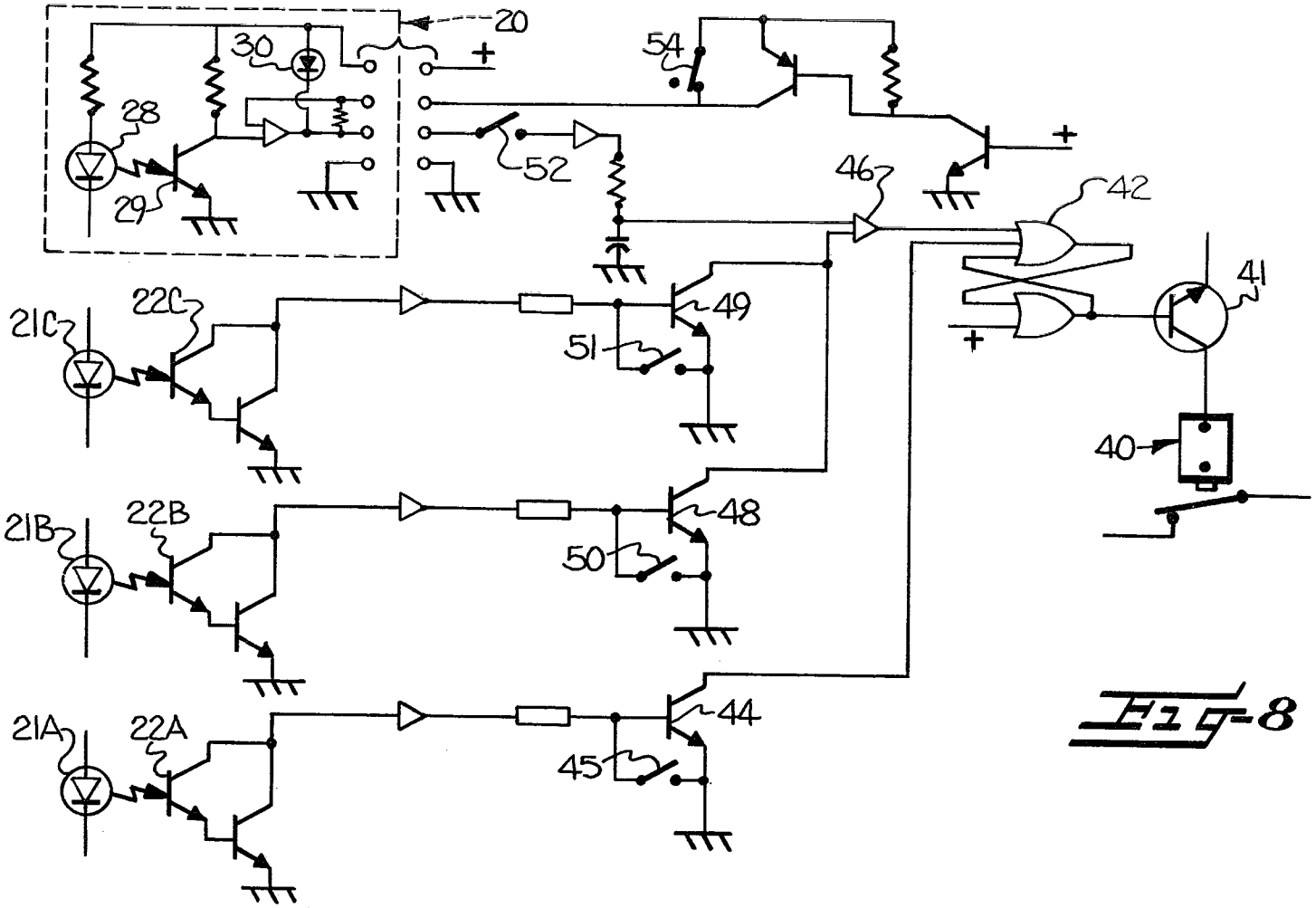
FIG. 8 is a simplified schematic representation of electrical circuitry useful in the present invention.

A schematic representation of electrical circuitry usable in an apparatus in accordance with the present invention is shown in FIG. 8. The circuitry there illustrated has been greatly simplified in order to facilitate understanding certain characteristics of the present invention, and persons skilled in the appropriate arts of electronic circuit design will understand that the realization of the operation here described may involve a differing detailed design of electronic circuitry. However, important characteristics of the circuitry to be used in accordance with the present invention will become more clear from the following discussion.

As will be noted, elements described above have been identified in FIG. 8 by like reference characters. Further, it will be noted that a control relay 40 is there shown which may operate to control the roving frame 10 in a manner generally known from prior disclosures. Energization of the winding of the relay 40 is under the control of a suitable transistor or other device 41 which is in turn controlled by appropriate gates generally indicated at 42. The gates provide for operation of the relay 40 and stopping of the roving frame 10 in accordance with predetermined control functions as described more fully hereinafter.

One input to the gates 42 is derived from a creel stop circuit responsive to the impingement of light from the light source 21A visible in FIG. 1 on the receiver 22A also visible there, In the form illustrated, the receiver 22A is a phototransistor Darlington amplifier, the signal from which is passed through an appropriate amplifier and pulse shaping circuit to a control transistor 44. An inhibit switch 45 is provided which permits selection of stop operation in response to a creel signal or no stop operation in response to a creel signal. The inhibition of a stop in response to a creel signal may be of significance during installation and operation of the apparatus in accordance with the present invention as discussed more fully hereinafter.

Another source for signals to the gates 42 is an amplifier 46 which receives signals from, among others, the front and rear flyer photoreceivers 22C, 22B. As will be noted from FIG. 8, similar amplifiers, pulse shaping circuits and control transistors 48, 49 are provided for these circuits, as are inhibit switches 50, 51.

The amplifier 46 additionally receives, by means of a time delay circuit and amplifier, signals originating from the plurality of individual end detectors 20. The circuitry of one such end detector has been illustrated in FIG. 8, where the bus connection for the individual end detectors 20 has been indicated by a bracketed connection. In similarity to the other circuits described briefly hereinabove, an inhibit switch 52 is additionally provided.

In accordance with yet another feature of the present invention, the circuitry of the individual end detectors 20 is supplied through a mode control circuit having a mode control switch 54. The mode control switch 54 governs a latching operation for the indicator 30. That is, depending upon the position of the mode selector switch 54, the indicator 30 will signal only immediately upon an indicated absence of a roving strand S (resulting from illumination of the receiver 29 by light emitted from the source 28) and thus may flicker or intermittently flash as a roving strand dances. It is the presence of such intermittent or short duration signals which leads to the inclusion of a time delay circuit between the individual end detectors 20 and the amplifier 46 by which control signals are forwarded to the gates 42 so as to control the operation of the relay 40. However, it is desirable upon some occasions to latch an indicator 30 in an illuminated condition. Where such operation is desired, the mode switch 54 may be set so as to cause latching of the indicator 30.

More particularly, upon initial installation of individual end detectors 20, it is important to assure that each individual end detector is properly aligned with respect to the corresponding roving strand S. For that reason, the roving frame 10 may be operated with the individual end detector inhibit switch 52 open and with the mode switch 54 set to latch the indicators 30 of the individual end detectors 20. Thus, upon the occurrence of any signal from an individual end detector 20, the indicator 30 of the corresponding end detector 20 would illuminate and remain illuminated without necessarily interrupting operation of the roving frame 10. The presence of such an illuminated indicator 30 for a given individual end detector 20 would facilitate a determination of those individual end detectors 20 requiring mounting adjustment for alignment purposes. Similarly, in the event that a specific roving frame 10 is experiencing false stops in that operation of the roving frame is being interrupted while the roving strands S continue to be properly formed, the individual end detector 20 responsible for such false stops may be relatively quickly identified by setting the mode switch 54 for latching operation.

As will be appreciated, the gates 42, together with the various inhibit and mode selection switches 45, 50, 51, 52, and 54, provide a great range of flexibility in the operation of the roving frame 10 equipped with the stop apparatus of the present invention. Further, identification of a cause of a false stop and correction of such a cause are facilitated.

In the drawings and specification, there has been set forth a preferred embodiment of the invention, and although specific terms are employed, they are used in a generic and descriptive sense only and not for purposes of limitation.

That which is claimed is:

1. In a roving frame having a row of drafting units and a row of aligned rotatable flyers for receiving textile roving strands from corresponding drafting units and forming wound packages therefrom, the combination therewith of a control system for stopping the operation of the roving frame upon the interruption of a strand, comprising a plurality of individual end detectors each cooperating with a corresponding roving strand for detecting the presence or absence of the roving strand as it passes along a path from one of said drafting units to a corresponding rotatable flyer, each individual end detector comprising a light source and a cooperating photoelectric receiver closely positioned on opposite sides of the roving strand path and means operatively associated with said photoelectric receiver for producing a control signal in response to the absence of the roving between said light source and said receiver;

photoelectric scanning means comprising a light source located adjacent one end of the roving frame and oriented for directing a beam of light longitudinally of the roving frame and a cooperating photoelectric receiver located adjacent the other end of the roving frame and in the path of light from said light source, and means operatively associated with said receiver for producing a control signal in response to a predetermined change in the intensity of the light from said light source, said scanning means having a scanning axis extending longitudinally of the roving frame and adjacent the paths of travel of the respective roving strands from said drafting units to said rotatable flyers, and means operable upon receipt of a control signal from any of said individual end detectors and said photoelectric scanning means for stopping the operation of said roving frame.

2. In a roving frame having a row of drafting units and a row of aligned rotatable flyers for receiving textile roving strands from corresponding drafting units and forming wound packages therefrom, the combination therewith of a control system for stopping the operation of the roving frame upon the interruption of a strand, comprising a plurality of individual end detectors each cooperating with a corresponding roving strand for detecting the presence or absence of the roving strand as it passes along a path from one of said drafting units to a corresponding rotatable flyer, each individual end detector comprising a light source and a cooperating photoelectric receiver closely positioned on opposite sides of the roving strand path and means operatively associated with said photoelectric receiver for producing a control signal in response to the absence of the roving between said light source and said receiver;

photoelectric scanning means comprising a plurality of light sources located adjacent one end of the roving frame and each oriented for directing a corresponding beam of light longitudinally of the roving frame and a cooperating plurality of photoelectric receivers located adjacent the other end of the roving frame and each positioned in the path of light from a corresponding one of said light sources, and means operatively associated with said receivers for producing a control signal in response to a predetermined change in the intensity of the light from said light sources, said scanning means having scanning axes extending longitudinally of the roving frame and adjacent the paths of travel of strands to said rotatable flyers, and means operable upon receipt of a control signal from any of said individual end detectors and said photoelectric scanning means for stopping the operation of said roving frame.

3. Apparatus according to one of claims 1, or 2 wherein each of said end detectors comprises a bifurcated housing having a pair of spaced generally parallel extending legs defining an open passageway for receiving a textile strand therebetween out of contact with the housing, said light source being located in one of said legs and oriented for directing a beam of light outwardly through said housing toward said other leg, said photoelectric receiver being located in said other leg and in the path of light from said light source, said receiver having a scanning axis extending across the open passageway defined between said legs, signal generating means located in said housing and operatively associated with said photoelectric receiver for producing a control signal in response to the absence of a textile strand obstructing the path of light from said light source to said receiver, and indicator means mounted in said housing and operatively connected to said signal generating means and actuable upon the production of a control signal for providing a visually observable indication of the functioning of the end detector, the presence of such visual indication while a strand is present indicating the need for adjustment of the position of the end detector relative to the strand in order to avoid production of improper control signals after such adjustment and while a strand is present between said light source and said receiver.

4. Apparatus according to claim 3 wherein each of said indicator means comprises an indicator light and further wherein electrical circuit means is operatively associated with said light and operable in one of two modes for illuminating said light and providing a visual indication of the functioning of the end detector, said electrical circuit means in a first mode being operable for illuminating said light so long as a control signal is being produced by said signal generating means, and said electrical circuit means in a second mode being operable for illuminating said light and maintaining the same in an illuminated condition upon the production of a control signal by said signal generating means.

5. Apparatus according to one of claims 1, or 2 wherein said means operable upon receipt of a control signal comprises electrical circuit means having gate means connected for receiving control signals from a plurality of said means for producing such signals and for responding to receipt of any one such signal by stopping the operation of said roving frame.

6. Apparatus according to claim 5 wherein said electrical circuit means further comprises inhibit switch means operatively interposed between said gate means and said means for producing control signals and effective for disabling a corresponding control signal from stopping the operation of said roving frame.

7. Apparatus according to claim 5 wherein said electrical circuit means comprises buss means extending adjacent the location of said end detectors and comprising a printed circuit card defining conductors common to the plurality of end detectors.

8. Apparatus according to one of claims 1, or 2 further comprising means for mounting said individual end detectors as a grouped array adjacent corresponding flyers and including an elongate tray member mounted on said roving frame and a plurality of mounting blocks for adjustably positioning corresponding ones of said individual end detectors in desired alignment with corresponding roving strands.

9. Apparatus according to claim 8 wherein each of said end detectors and corresponding ones of said mounting blocks define elongate slots, said slots extending at substantially right angles one relative to another, and further wherein said mounting means comprises bolts penetrating said slots and accommodating adjustment of relative positions of said individual end detectors and corresponding ones of said mounting blocks along mutually perpendicular slot axes.

10. An end detector for detecting an interruption in an individual textile strand being processed on a textile machine, said end detector comprising a light source and a cooperating photoelectric receiver mounted in closely spaced relation to one another for passage of a textile strand therebetween, signal generating means operatively associated with said photoelectric receiver for producing a control signal in response to the absence of the textile strand between said light source and said receiver, and indicator means operatively connected to said signal generating means and actuable upon the production of a control signal for providing a visually observable indication of the functioning of the end detector, said indicator means comprising an indicator light and electrical circuit means operatively associated with said light and operable in one of two modes for illuminating said light and providing a visual indication of the functioning of the end detector, said electrical circuit means in said first mode being operable for illuminating said light so long as a control signal is being produced by said signal generating means, and said electrical circuit means in said second mode being operable for illuminating said light and maintaining the same in an illuminated condition upon the production of a control signal by said signal generating means, the presence of such visual indication while a strand is present indicating the need for adjustment of the position of the end detector relative to the strand in order to avoid production of improper control signals after such adjustment and while a strand is present between said light source and said receiver.

11. An end detector according to claim 10 wherein said indicator means comprises an indicator light and electrical circuit means operatively associated with said light and operable in one of two modes for illuminating said light and providing a visual indication of the functioning of the end detector, said electrical circuit means in said first mode being operable for illuminating said light so long as a control signal is being produced by said signal generating means, and said electrical circuit means in said second mode being operable for illuminating said light and maintaining the same in an illuminated condition upon the production of a control signal by said signal generating means.

12. An end detector according to claim 10 including a bifurcated housing having a pair of spaced generally parallel extending legs defining an open passageway therebetween for receiving the textile strand therebetween out of contact with the housing, said light source being located in one leg, said photoelectric receiver being located in the other leg, and said signal generating means and said indicator means also being located within said housing.

13. An end detector for detecting an interruption in an individual textile strand being processed on a textile machine, said end detector comprising a bifurcated housing having a pair of spaced generally parallel extending legs defining an open passageway for receiving a textile strand therebetween out of contact with the housing, a light source located in one of said legs and oriented for directing a beam of light outwardly of said housing toward said other leg, photoelectric receiver located in said other leg and in the path of light from said light source, said receiver, having a scanning axis extending across the open passageway defined between said legs, signal generating means located in said housing and operatively associated with said photoelectric receiver for producing a control signal in response to the absence of a textile strand obstructing the path of light from said light source to said receiver, and indicator means mounted in said housing and operatively connected to said signal generating means and actuable upon the production of a control signal for providing a visually observable indication of the functioning of the end detector, said indicator means comprising an indicator light and electrical circuit means operatively associated with said light and operable in one of two modes for illuminating said light and providing a visual indication of the functioning of the end detector, said electrical circuit means in said first mode being operable for illuminating said light so long as a control signal is being produced by said signal generating means, and said electrical circuit means in said second mode being operable for illuminating said light and maintaining the same in an illuminated condition upon the production of a control signal by said signal generating means, the presence of such visual indication while a strand is present indicating the need for adjustment of the position of the end detector relative to the strand in order to avoid production of improper control signals after such adjustment and while a strand is present between said light source and said receiver.

* * * * *